US008426350B2

(12) United States Patent
Geret et al.

(10) Patent No.: US 8,426,350 B2
(45) Date of Patent: Apr. 23, 2013

(54) DETERGENT COMPOSITION

(75) Inventors: Laurence Geret, Pulhelm-Stommeln (DE); Thomas Hardt, Würselen (DE)

(73) Assignee: Reckitt Benckiser N.V., WT Hoofddorp (NL)

( * ) Notice: Subject to any disclaimer, the term of this patent is extended or adjusted under 35 U.S.C. 154(b) by 69 days.

(21) Appl. No.: 12/377,237

(22) PCT Filed: Aug. 17, 2007

(86) PCT No.: PCT/GB2007/003164

§ 371 (c)(1), (2), (4) Date: Jan. 13, 2010

(87) PCT Pub. No.: WO2008/020234

PCT Pub. Date: Feb. 21, 2008

(65) Prior Publication Data

US 2010/0249006 A1 Sep. 30, 2010

(30) Foreign Application Priority Data

Aug. 18, 2006 (GB) ..... 0616444.6

(51) Int. Cl.

| | |
|---|---|
| ***C11D 17/00*** | (2006.01) |
| ***C11D 3/00*** | (2006.01) |
| ***C11D 3/28*** | (2006.01) |
| ***C11D 3/386*** | (2006.01) |
| ***C11D 3/395*** | (2006.01) |
| ***C11D 3/39*** | (2006.01) |
| ***B08B 9/20*** | (2006.01) |

(52) U.S. Cl.

USPC ..... 510/446; 510/224; 510/226; 510/227; 510/298; 510/375; 510/378; 134/25.2; 8/137

(58) Field of Classification Search ..... 510/446, 510/224, 226, 227, 298, 375, 378; 134/25.2; 8/137

See application file for complete search history.

(56) References Cited

U.S. PATENT DOCUMENTS

| | | | | |
|---|---|---|---|---|
| 4,099,912 | A | 7/1978 | Ehrlich | |
| 6,013,613 | A * | 1/2000 | Scheper et al. | 510/220 |
| 6,194,368 | B1 * | 2/2001 | Waschenbach et al. | 510/224 |
| 6,306,808 | B1 * | 10/2001 | Hazenkamp et al. | 510/224 |
| 6,306,914 | B1 * | 10/2001 | de Ziegler et al. | 514/171 |
| 6,340,664 | B1 * | 1/2002 | Gassenmeier et al. | 510/441 |
| 6,387,861 | B1 * | 5/2002 | Van Asperen et al. | 510/298 |
| 6,410,500 | B1 * | 6/2002 | Haerer et al. | 510/446 |
| 6,544,944 | B1 * | 4/2003 | Ricci et al. | 510/446 |
| 6,551,981 | B1 * | 4/2003 | Ricci et al. | 510/446 |
| 6,589,932 | B1 * | 7/2003 | Ricci et al. | 510/446 |
| 6,809,073 | B2 * | 10/2004 | Hoflinger et al. | 510/446 |
| 2002/0028759 | A1 * | 3/2002 | Appel et al. | 510/446 |
| 2002/0137649 | A1 * | 9/2002 | Carnali et al. | 510/220 |

FOREIGN PATENT DOCUMENTS

| | | | |
|---|---|---|---|
| DE | 20106897 | U1 * | 8/2001 |
| DE | 20106897 | U1 | 9/2001 |
| EP | 1239029 | A1 * | 9/2002 |
| GB | 2419838 | A * | 5/2006 |
| WO | 01/42417 | A1 | 6/2001 |

OTHER PUBLICATIONS

English Language Abstract for DE20106897 taken from Google Translate.

* cited by examiner

*Primary Examiner* — Lorna M Douyon

(74) *Attorney, Agent, or Firm* — Norris McLaughlin & Marcus PA

(57) ABSTRACT

A detergent composition comprising three or more distinct regions, the composition comprising one or more anti-corrosion agents and a bleaching compound, wherein, the bleaching compound is predominantly located in a first distinct region, and the one or more anti-corrosion agents are predominantly located in a second distinct region having a pH in the range of from 5 to 8.9 which second distinct region is not in direct contact with the first distinct region, and further wherein the second distinct region has a lower pH than the first distinct region.

18 Claims, No Drawings

DETERGENT COMPOSITION

This is an application filed under 35 USC 371 of PCT/GB2007/003164.

TECHNICAL FIELD

The present invention relates to detergent compositions having distinct regions and comprising an anti-corrosion agent and a bleaching compound. In particular the present invention relates to such a detergent composition wherein the bleaching compound and the anti-corrosion agent are predominantly located in distinct regions which are not in direct contact with each other.

BACKGROUND AND PRIOR ART

It has been is well known that detergent compositions comprising both an anti-corrosion agent and a bleaching compound typically suffer from stability problems because of the detrimental effect of the bleaching compound upon the anti-corrosion agent. This results in either 1) loss of performance of the anti-corrosion agent and hence the detergent compound known, and/or 2) the need to include increased levels of the anti-corrosion agent in the detergent composition thus increasing cost.

WO 01/42417 discloses multiphase detergent tablets comprising a bleach compound in one layer and a corrosion inhibitor in another layer, which layers contact each other.

DE 20106287U1 discloses a multiphase detergent tablets comprising a bleaching compound and a corrosion inhibitor.

U.S. Pat. No. 4,099,912 discloses a series of laundry detergent tablets. These detergent tablets comprise different ingredients with the consumer selecting a combination of individual detergent tablets according to the needs for a given laundry load.

However, whilst the aforementioned documents disclose compositions which go some way towards providing an improvement in the stability of compositions comprising these materials there is still a need in the art to provide stable compositions.

It is an object of the present invention to address one or more of the above-mentioned problems. In particular, it is an object of the present invention to provide detergent compositions exhibiting good stability of the anti-corrosion agent. It is a further object of the present invention to provide detergent compositions exhibiting good performance. It is still a further object of the present invention to provide detergent compositions exhibiting good stability of the anti-corrosion agent and good anti-corrosion performance.

STATEMENT OF INVENTION

According to the present invention there is provided a detergent composition comprising three or more distinct regions, the composition comprising one or more anti-corrosion agents and a bleaching compound, wherein, a) the bleaching compound is predominantly located in a first distinct region, and b) the one or more anti-corrosion agents are predominantly located in a second distinct region having a pH in the range of from 5 to 8.9 which second distinct region is not in direct contact with the first distinct region, and further wherein the second distinct region has a lower pH than the first distinct region.

It is especially preferred that the detergent composition according to the invention is a dishwashing composition and in particular an automatic dishwashing composition.

It is also preferred that the first distinct region comprises 10% wt or less of the total amount of anti-corrosion agents and/or that the second distinct region comprises at least 60% wt, more preferably 100% wt, of the total amount of anti-corrosion agents present in the composition.

It is also preferred that the first distinct region comprises at least 60% wt, preferably 100% wt, of the total amount of bleaching compound and/or that the second distinct region comprises 10% wt or less of the total amount of bleaching compound in the detergent composition.

One especially preferred detergent composition according to the invention is a composition wherein, a) the first distinct region is substantially free of anti-corrosion agents, b) the second distinct region comprises at least 95% wt of the total amount of anti-corrosion agents in the detergent composition, and c) at least one further distinct region located between the first and second distinct regions comprises less than 5% wt of the total amount of anti-corrosion agents in the composition.

The pH of the first distinct region is preferably in the range of from pH 9 to pH 13. The pH of the second distinct region is preferably in the range of from pH 5.2 to 8.5.

It is also preferred that the at least one anti-corrosion agents is/are selected from benzotriazole or bis-benzotriazole and substituted derivatives thereof and/or metal salts or complexes chosen from the group consisting of zinc, manganese, cobalt and bismuth salts and/or complexes. Preferably the at least one anti-corrosion agent comprises a (substituted) benzotriazole predominantly located in the region in which the anti-corrosion agent is predominantly located.

Preferably the bleaching compound is selected from the sodium and potassium salts of percarbonate, perborate and persulphate. An amount of from 5 to 25% wt of the bleaching compound is preferred.

Although the detergent composition may comprise a mixture of solid and non solid (such as gel) distinct regions, it is preferred that the detergent composition comprises at least two distinct regions which are solid, preferably three. It is preferred that the second distinct region predominantly comprising the anti-corrosion agents is a solid and is produced by pressing a (particulate) material to produce that region.

According to a particular embodiment of the present invention a detergent composition comprising three distinct regions is provided comprising;

1) a first distinct region in which the bleaching compound is predominantly located, the first distinct region having a pH in the range 10 to 12 and comprising 40 to 80% wt of the total weight of the composition 2) a second distinct region in which the anti-corrosion agents is/are predominantly located, the second distinct region having a pH in the range of from 5.5 to 8 and comprising 2 to 15% wt of the total weight of the composition, and 3) a further distinct region having a pH in the range of from pH 10 to 12 and comprising from 15 to 35% wt of the total weight of the composition.

It is preferred that the compositions of the invention further comprise an enzyme.

According to a second embodiment there is provided the use of a detergent composition of the invention according to the first aspect in a cleaning operation.

According to a third embodiment there is provided a process of cleaning soiled items by contacting therewith the detergent composition of the first aspect.

Surprisingly, it has been found that compositions according to the invention exhibit good stability of the anti-corrosion agent and/or good anti-corrosion performance.

Unless stated otherwise, all amounts herein are given as the percentage by weight of active ingredient based upon the weight of the total composition.

The term 'distinct region' as used herein means a region either having a different composition to the adjacent region(s) or which is formed is in separate operation to the adjacent region(s).

The term 'predominantly located' as used herein means that 50.0% wt or more, preferably more than 50.0% wt and most preferably 55% wt or more of the total amount of that material in the detergent composition is located in the stated region.

The term 'not in direct contact with' as used herein in relation to the distinct regions of the detergent composition means that those regions do not physically contact each other e.g. they are separated by one or more other distinct regions of the detergent composition.

The term 'substantially free of' as used herein means less than 0.5% wt based on the total weight of that material in the detergent composition.

The pH of the distinct region is measured by dissolving the region in water to produce a 1% wt solution and measuring the pH at 20° C.

DETAILED DESCRIPTION

The present invention will now be described in further detail.

a) Types of Detergent Compositions

The detergent compositions of the invention may be used in principle for any cleaning operation. However, it is preferred that the detergent compositions hard surface cleaning compositions for example dishwashing detergents, floor cleaners or surface cleaners. It is most preferred that the hard surface cleaning compositions are dishwashing compositions and in particular automatic dishwashing compositions.

The detergent composition may be used to clean soft surfaces such as fabrics and upholstery material and hard surfaces such as crockery, cutlery and household surfaces.

b) Detergent Composition Format

The detergent compositions of the present invention may be of any suitable form which allows the composition to be comprised of two or more distinct regions, preferably three or more. Typically the detergent composition will be in the form of a shaped body such as a tablet, rod, ball or lozenge or a paste or gel composition provided that distinct regions of the composition may still be provided. According to the present invention it is preferred that at least one distinct region of the tablet is solid (e.g. compressed powder, cast, injection moulded or extruded material), preferably at least two distinct regions and more preferably at least three distinct regions. It is most preferred that no more than two phases are gel phases and preferably at most a single phase is a gel. According to one embodiment of the invention all of the distinct regions of the detergent composition are solid. According to another embodiment the detergent composition comprises two or more solid distinct regions and one or two gel or paste phases, preferably one. When the detergent composition comprises both solid and gel/paste phases, any suitable arrangement of these phases may be used as desired.

For many applications e.g. an automatic dishwashing product, the detergent composition is preferably in the form of a unit dose product, i.e. a form which is designed to be used as a single portion of detergent composition in a washing operation. Of course, one or more of such single portions may be used in a cleaning operation.

The composition may be encased in a water soluble wrapping, for, example of PVOH or a cellulosic material. If such a wrapping is used, the detergent composition is preferably substantially surrounded thereby, most preferably totally surrounded thereby.

c) Distinct Regions of the Detergent Composition

The detergent compositions of the invention comprise three or more distinct regions. Typically the compositions comprise three distinct regions although four or five distinct regions may be suitable for some applications.

The distinct regions of the composition will generally be of differing formulations. However, two or more distinct regions may have the same, or very similar, formulations if desired.

According to one embodiment of the invention, a further distinct region which separates the first and second distinct regions in which the bleaching compound/anti-corrosion agent are predominantly located comprises less than 10% wt, preferably less than 5% wt, of the total amount of bleaching compound and less than 10% wt, preferably less than 5% wt, of the total amount of anti-corrosion agent in the detergent composition.

According to the present invention, the distinct region in which the anti-corrosion agent is predominantly located (anti-corrosion region) has a different pH to the distinct region in which the bleaching compound is predominantly located (bleaching compound region).

According to the invention the second distinct (anti-corrosion agent) region has a lower pH than the first distinct (bleaching compound) region; it has a pH in the range of from pH 5 to 8.9, preferably 5.2 to 8.5, more preferably 5.5 to 8, such as 6 to 7.5, e.g. 6 to 7. The pH of the first distinct (bleaching compound) region is preferably in the range of from pH 9 to 13, preferably 9.5 to 12.5, more preferably 10 to 12, such as 10.5 to 11.5, e.g. 10.5 to 11.

It is preferred that the second distinct region represents 1 to 20% wt, preferably 2 to 15% wt, more preferably 3 to 10% wt, such as 4 to 8% wt of the total weight of the composition. It is also preferred that at least one further distinct region (other than the bleaching compound region) represents (in total if there is more than one) from 10 to 40% wt, preferably from 15 to 35% wt, more preferably from 20 to 30% wt of the total weight of the composition. It is also preferred that bleaching compound region represents 30 to 85% wt, preferably 40 to 80% wt, more preferably 50 to 75% wt, such as 60 to 70% wt of the total weight of the composition.

In a particularly preferred embodiment of the present invention, the detergent composition comprises three distinct regions;

1) a first distinct region in which the bleaching compound region is predominantly located, the first distinct region having a pH in the ranges hereinabove and comprising 30 to 85% wt, preferably 40 to 80% wt, more preferably 50 to 75% wt, such as 60 to 70% wt of the total weight of the composition, and 2) a second distinct region in which the anti-corrosion agent is predominantly located, the second distinct region having a pH in the ranges hereinabove and comprising 1 to 20% wt, preferably 2 to 15% wt, more preferably 3 to 10% wt, such as 4 to 8% wt of the total weight of the composition, and 3) a further distinct region having a pH in the range pH 9 to 13, preferably 10-12 and comprising from 10 to 40% wt, preferably from 15 to 35% wt, more preferably from 20 to 30% wt of the total weight of the composition.

This arrangement has been found to provide a very good combination of stability and anti-corrosion performance as the overall pH of the detergent composition aids good performance.

The distinct regions may be adhered/joined together by any suitable means e.g. by compression the regions together or by using a material which acts to adhere the regions together. Any suitable material may be used as an adhesive material between two or more distinct regions.

d) Bleaching Compound

The detergent compositions of the invention comprise a bleaching compound in a first distinct region. The bleaching compound may be located in one or more distinct regions of the detergent composition provided that it is predominantly located in a first distinct region which is not in direct contact with the second distinct region in which the anti-corrosion agent is predominantly located.

It is preferred that the first distinct region in which the bleaching compound is predominantly located comprises at least 60% wt of the total amount of bleaching compound present in the detergent composition, more preferably at least 70% wt, even more preferably at least 80% wt, such as at least 90% wt, for example at least 95% wt, better 99% wt and most preferably 100% wt.

If the bleaching compound is located in a distinct region in which any of the anti-corrosion agent is co-located, eg. the second distinct region, it is preferred that 10% wt or less of the total amount of bleaching compound, more preferably 5% wt or less, such as 2% wt or less, better 1% wt or less is located in that region and especially that this region is substantially free of the bleaching compound.

Any type of bleaching compound conventionally used in detergent compositions may be used according to the present invention. Preferably the bleaching compound is selected from inorganic peroxides or organic peracids, derivatives thereof (including their salts) and mixtures thereof. Especially preferred inorganic peroxides are percarbonates, perborates and persulphates with their sodium and potassium salts being most preferred. Sodium percarbonate and sodium perborate are most preferred, especially sodium percarbonate.

Organic peracids include all organic peracids traditionally used as bleaches, including, for example, perbenzoic acid and peroxycarboxylic acids such as mono- or diperoxyphthalic acid, 2-octyldiperoxysuccinic acid, diperoxydodecanedicarboxylic acid, diperoxy-azelaic acid and imidoperoxycarboxylic acid and, optionally, the salts thereof. Especially preferred is phthalimidoperhexanoic acid (PAP).

Desirably the bleaching compound is present in the compositions in an amount of from 1 to 30 wt %, especially 5 to 25 wt %, most preferably 10 to 20% wt. The amount of bleaching compound typically present in each distinct region of the detergent compositions will depend upon the % wt of the total amount of bleaching compound to be included in that distinct region and the total amount to be used in the detergent composition. The typical amounts to be used in the different distinct regions can be calculated from the information given hereinabove.

e) Anti-Corrosion Agents

The detergent compositions of the present invention comprise one or more anti-corrosion agents. These anti-corrosion agents may provide benefits against corrosion of glass and/or metal and the term encompasses agents that are intended to prevent or reduce the tarnishing of non-ferrous metals, in particular of silver and copper. In many detergent compositions according to the present invention it may be desirable to include more than one type of anti-corrosion agent to provide protection against corrosion of glass and metals.

It is known to include a source of multivalent ions in detergent compositions, and in particular in automatic dishwashing compositions, for anti-corrosion benefits. For example, multivalent ions and especially zinc, cobalt bismuth and/or manganese salts have been included for their ability to inhibit such corrosion. Organic and inorganic redox-active substances which are known as suitable for use as silver/copper corrosion inhibitors are mentioned in WO 94/26860 and WO 94/26859. Suitable inorganic redox-active substances are, for example, metal salts and/or metal complexes chosen from the group consisting of zinc, manganese, bismuth titanium, zirconium, hafnium, vanadium, cobalt and cerium salts and/or complexes, the metals being in one of the oxidation states II, III, IV, V or VI. Particularly suitable metal salts and/or metal complexes are chosen from the group consisting of $MnSO_4$, Mn(II) citrate, Mn(II) stearate, Mn(II) acetylacetonate, Mn(II) [1-hydroxyethane-1,1-diphosphonate], $V_2O_5$, $V_2O_4$, $VO_2$, $TiOSO_4$, $K_2TiF_6$, $K_2ZrF_6$, $CoSO_4$, $Co(NO_3)_2$ and $Ce(NO_3)_3$. Any suitable source of multivalent ions may be used, with the source preferably being chosen from sulphates, carbonates, acetates, gluconates and metal-protein compounds. Zinc, bismuth, cobalt and manganese salts are specially preferred corrosion inhibitors.

Preferred silver/copper anti-corrosion agents are benzotriazole (BTA) or bis-benzotriazole and substituted derivatives thereof. Other suitable agents are organic and/or inorganic redox-active substances and paraffin oil. Benzotriazole derivatives are those compounds in which the available substitution sites on the aromatic ring are partially or completely substituted. Suitable substituents are linear or branch-chain $C_{1-20}$ alkyl groups and hydroxyl, thio, phenyl or halogen such as fluorine, chlorine, bromine and iodine. A preferred substituted benzotriazole is tolyltriazole (TTA).

Therefore, especially preferred anti-corrosion agents according to the present invention are selected from metal salts or complexes chosen from the group consisting of zinc, bismuth, colbalt and manganese salts and/or benzotriazoles or bis-benzotrizole, including substituted benzotriazoles such as TTA. In particular a source of (i) zinc ions and (ii) unsubstituted benzotriazole or TTA is preferred as anti-corrosion agents and a mixture of these ingredients is especially preferred according to the invention.

Any conventional amount of the anti-corrosion agents may be included in the compositions of the invention. However, it is preferred that they are present in an total amount of from 0.01% wt to 5% wt, preferably 0.05% wt to 3% wt, more preferably 0.1 to 2.5% wt, such as 0.2% wt to 2% wt based on the total weight of the composition. If more than one anti-corrosion agent is used, the individual amounts may be within the preceding amounts given but the preferred total amounts still apply.

It is preferred that the second distinct region comprises at least 60% wt of the total amount of anti-corrosion agent present in the detergent composition, more preferably at least 70% wt, even more preferably at least 80% wt, such as at least 90% wt, for example at least 95% wt, better 99% wt and most preferably 100% wt.

If any anti-corrosion agent is located in a distinct region in which any of the bleaching compound is co-located, eg. the first distinct region, it is preferred that 10% wt or less of the total amount of anti-corrosion agent in the detergent composition, more preferably 5% wt or less, such as 2% wt or less, better 1% wt or less is located in that region and especially that this region is substantially free of anti-corrosion agent.

According to a particularly preferred embodiment of the invention;

the first distinct region in which the bleaching compound is predominantly located is substantially free, and more preferably is free, of anti-corrosion agent, the second distinct region in which the anti-corrosion agent is predominantly located comprises at least 95% wt, preferably at least 99% wt, most preferably 100% wt, of the total amount of anti-corrosion agent, and at least one further distinct region located between the aforesaid two regions comprises less than 5% wt, more preferably 1% wt or less of the total amount of anti-corrosion agent in the composition.

It is preferred that the at least one anti-corrosion agent comprises a benzotriazole (eg. BTA or TTA) predominantly, and more preferably only, located in the region in which the anti-corrosion agent is predominantly located.

f) Optional Ingredients

The compositions of the invention may further comprise one or more of the following optional ingredients in any one or more of the different regions of the detergent composition. The amount of any of the optional ingredients typically present in each distinct region of the detergent compositions will depend upon the % wt of the total amount of that ingredient desired to be included in that distinct region and the total amount to desired be used in the detergent composition. The typical amounts to be included in the different distinct regions can be calculated from the information given herein.

The detergent compositions preferably comprise one or more bleach activators. Any suitable bleach activator may be included for example TAED. Conventional amounts may be used e.g. in amounts of from 0.01 to 10 wt %, more preferred of from 0.1 to 8 wt % and most preferred of from 0.5 to 5 wt % based on the weight of the total composition.

The bleach activator may be located in any distinct region of the detergent compositions but it is preferred that it is predominantly located in a region other than that in which the bleaching compound is predominantly located. Most preferably the distinct region(s) comprising the bleach activator comprise(s) less than 10% wt of individually the total amount of bleaching compound and enzyme in the composition, preferably less than 5% wt. It is especially preferred that the distinct region(s) comprising the bleach activator comprise are substantially free from bleaching compound and enzyme (if one is present in the compositions). According to a particular embodiment of the present invention the bleach activator is located in a distinct region located between the first and second distinct regions in which the bleaching compound and the anti-corrosion agent are predominantly located.

The detergent compositions of the invention very preferably comprise an enzyme. The enzyme may be located in one or more distinct regions of the detergent composition and is preferably predominantly located in a distinct region which is not in direct contact with the distinct region in which the bleaching compound is predominantly located.

If any enzyme is located in more than one distinct region of the tablet then any desired proportion of the total amount present in the compositions may be included in each region. However, according to an especially preferred embodiment of the present invention the enzyme is predominantly located in a distinct region(s) other than the distinct region in which the bleaching compound is located. More preferably, according to a very preferred embodiment of the present invention, the enzyme is predominantly located in a distinct region(s) which comprise(s) less than 10% wt of the total amount of bleaching compound in the detergent composition and preferably at least 60% wt, better at least 80% wt, such as at least 90% wt and preferably 100% wt (when a single region) of the total amount of anti-corrosion agent in the detergent composition.

According to one embodiment of the invention, the detergent composition comprises an anti-corrosion agent and an enzyme and the region in which the anti-corrosion agent is predominantly located is also the region in which the enzyme is predominantly located.

It is preferred that the distinct region in which the enzyme is predominantly located comprises at least 60% wt of the total amount of enzyme present in the detergent composition, more preferably at least 70% wt, even more preferably at least 80% wt, such as at least 90% wt, for example at least 95% wt, better 99% wt and most preferably 100% wt.

If the enzyme is located in a distinct region in which any of the bleaching compound is co-located, it is preferred that 10% wt or less of the total amount of enzyme in the detergent composition, more preferably 5% wt or less, such as 2% wt or less, better 1% wt or less is located in that region and especially that this region is substantially free of enzyme.

It is preferred that one or more distinct regions located between the distinct region predominantly comprising the bleaching compound and the distinct region predominantly comprising the enzyme comprise(s) 20% wt or less of the total amount of enzyme and bleaching compound, more preferably 10% wt or less, such as 5% wt or less and most preferably is/are substantially free of enzyme and bleaching compound.

Desirably enzyme is present in the compositions in an amount of from 0.01 to 3 wt %, especially 0.01 to 2 wt %, for each type of enzyme when added as a commercial preparation. As they are not 100% active preparations this represents an equivalent amount of 0.005 to 1 wt % of pure enzyme, preferably 0.01 to 0.75 wt %, especially 0.01 to 0.5% wt of each enzyme used in the compositions. The total amount of enzyme in the detergent composition is preferably in the range of from 0.01 to 6 wt %, especially 0.01 to 3 wt %, which represents an equivalent amount of 0.01 to 2 wt % of pure enzyme, preferably 0.02 to 1.5 wt %, especially 0.02 to 1% wt of total enzyme used in the compositions.

Any type of enzyme conventionally used in detergent compositions may be used according to the present invention. It is preferred that the enzyme is selected from proteases, lipases, amylases, cellulases and peroxidases. It is most preferred that protease and/or amylase enzymes are included in the compositions according to the invention; such enzymes are especially effective for example in dishwashing detergent compositions. Any suitable species of these enzymes may be used as desired.

The amount of any enzyme present in each distinct region of the detergent compositions will depend upon the % wt of the total amount of enzyme to be included in that distinct region and the total amount to be used in the detergent composition. The typical amounts to be included in the different distinct regions can be calculated from the information given hereinabove.

When the first distinct region predominantly comprising the anti-corrosion agent is a solid it may be produced by any suitable means e.g. by pressing (compacting) of a particulate material, extrusion, casting or injection moulding. However, according to one embodiment of the present invention it is especially preferred that this region is produced by pressing a (particulate) material to produce a solid distinct region. This has the advantage that the process can be carried out at approximately room temperature or at temperatures up to about 40° C. which is preferably for many reasons, including economic ones.

The detergent compositions of the invention may contain surface active agents, for example, anionic, cationic, amphoteric or zwitterionic surface active agents or mixtures thereof. Many such suitable surfactants are described in Kirk Othmer's Encyclopedia of Chemical Technology, 3rd Ed., Vol. 22, pp. 360-379, "Surfactants and Detersive Systems", incorporated by reference herein. In general, bleach-stable surfactants are preferred for use in at least the distinct region comprising the bleaching material.

A preferred class of nonionic surfactants are ethoxylated non-ionic surfactants prepared by the reaction of a monohydroxy alkanol or alkylphenol with 6 to 20 carbon atoms. Preferably the surfactants have at least 12 moles particularly preferred at least 16 moles, and still more preferred at least 20 moles, such as at least 25 moles of ethylene oxide per mole of alcohol or alkylphenol.

Particularly preferred non-ionic surfactants are the nonionics from a linear chain fatty alcohol with 16-20 carbon atoms and at least 12 moles, particularly preferred at least 16 and still more preferred at least 20 moles, of ethylene oxide per mole of alcohol.

According to one embodiment of the invention, the nonionic surfactants additionally may comprise propylene oxide units in the molecule. Preferably these PO units constitute up to 25% by weight, preferably up to 20% by weight and still more preferably up to 15% by weight of the overall molecular weight of the non-ionic surfactant.

Surfactants which are ethoxylated mono-hydroxy alkanols or alkylphenols, which additionally comprises polyoxyethylene-polyoxypropylene block copolymer units may be used. The alcohol or alkylphenol portion of such surfactants constitutes more than 30%, preferably more than 50%, more preferably more than 70% by weight of the overall molecular weight of the non-ionic surfactant.

Another class of suitable non-ionic surfactants includes reverse block copolymers of polyoxyethylene and polyoxypropylene and block copolymers of polyoxyethylene and polyoxypropylene initiated with trimethylolpropane.

Another preferred class of nonionic surfactant can be described by the formula:

$$R^1O[CH_2CH(CH_3)O]_x[CH_2CH_2O]_y[CH_2CH(OH)R^2]$$

where $R^1$ represents a linear or branched chain aliphatic hydrocarbon group with 4-18 carbon atoms or mixtures thereof, $R^2$ represents a linear or branched chain aliphatic hydrocarbon rest with 2-26 carbon atoms or mixtures thereof, x is a value between 0.5 and 1.5 and y is a value of at least 15.

Another group of preferred nonionic surfactants are the end-capped polyoxyalkylated non-ionics of formula:

$$R^1O[CH_2CH(R^3)O]_x[CH_2]_kCH(OH)[CH_2]_jOR^2$$

where $R^1$ and $R^2$ represent linear or branched chain, saturated or unsaturated, alyphatic or aromatic hydrocarbon groups with 1-30 carbon atoms, $R^3$ represents a hydrogen atom or a methyl, ethyl, n-propyl, iso-propyl, n-butyl, 2-butyl or 2-methyl-2-butyl group, x is a value between 1 and 30 and, k and j are values between 1 and 12, preferably between 1 and 5. When the value of x is >2 each $R^3$ in the formula above can be different. $R^1$ and $R^2$ are preferably linear or branched chain, saturated or unsaturated, alyphatic or aromatic hydrocarbon groups with 6-22 carbon atoms, where group with 8 to 18 carbon atoms are particularly preferred. For the group $R^3H$, methyl or ethyl are particularly preferred. Particularly preferred values for x are comprised between 1 and 20, preferably between 6 and 15.

As described above, in case x>2, each $R^3$ in the formula can be different. For instance, when x=3, the group $R^3$ could be chosen to build ethylene oxide ($R^3$=H) or propylene oxide ($R^3$=methyl) units which can be used in every single order for instance (PO)(EO)(EO), (EO)(PO)(EO), (EO)(EO)(PO), (EO)(EO)(EO), (PO)(EO)(PO), (PO)(PO)(EO) and (PO)(PO). The value 3 for x is only an example and bigger values can be chosen whereby a higher number of variations of (EO) or (PO) units would arise.

Particularly preferred end-capped polyoxyalkylated alcohols of the above formula are those where k=1 and j=1 originating molecules of simplified formula:

$$R^1O[CH_2CH(R^3)O]_xCH_2CH(OH)CH_2OR^2$$

The use of mixtures of different nonionic surfactants is suitable in the context of the present invention for instances mixtures of alkoxylated alcohols and hydroxy group containing alkoxylated alcohols.

Other suitable surfactants are disclosed in WO 95/01416, to the contents of which express reference is hereby made.

Preferably the non-ionic surfactants are present in the compositions of the invention in an amount of from 0.1% wt to 5% wt, more preferably 0.5% wt to 3% wt, such as 0.5 to 3% wt. The total amount of surfactants typically included is in amounts of up to 15% wt, preferably of from 0.5% wt to 10% wt, such as 1% wt to 5% wt. The distinct regions may contain any proportion of the total amount of surfactants as desired.

The detergent compositions may also comprise conventional amounts of detergent builders which may be either phosphorous based or non-phosphorous based, or even a combination of both types. Suitable builders are well known in the art.

If phosphorous builders are to be used in the detergent compositions of the inventions then it is preferred that monophosphates, di-phosphates, tri-polyphosphates or oligomeric-poylphosphates are used. The alkali metal salts of these compounds are preferred, in particular the sodium salts. An especially preferred builder is sodium tripolyphosphate (STPP).

The non-phosphorous based builder may be organic molecules with carboxylic group(s), amino acid based compound or a succinate based compound. The term 'succinate based compound' and 'succinic acid based compound' are used interchangeably herein.

Builder compounds which are organic molecules containing carboxylic groups include citric acid, fumaric acid, tartaric acid, maleic acid, lactic acid and salts thereof. In particular the alkali or alkaline earth metal salts of these organic compounds may be used, and especially the sodium salts. An especially preferred builder is sodium citrate.

Preferred examples of amino acid based compounds according to the invention are MGDA (methyl-glycine-diacetic acid, and salts and derivatives thereof) and GLDA (glutamic-N,N-diacetic acid and salts and derivatives thereof). GLDA (salts and derivatives thereof) is especially preferred according to the invention, with the tetrasodium salt thereof being especially preferred. Other suitable builders are described in U.S. Pat. No. 6,426,229 which is incorporated by reference herein. Particular suitable builders include; for example, aspartic acid-N-monoacetic acid (ASMA), aspartic acid-N,N-diacetic acid (ASDA), aspartic acid-N-monopropionic acid (ASMP), iminodisuccinic acid (IDA), N-(2-sulfomethyl) aspartic acid (SMAS), N-(2-sulfoethyl)aspartic acid (SEAS), N-(2-sulfomethyl)glutamic acid (SMGL), N-(2-sulfoethyl)glutamic acid (SEGL), N-methyliminodiacetic acid (MIDA), α-alanine-N,N-diacetic acid (α-ALDA), β-alanine-N,N-diacetic acid (β-ALDA), serine-N,N-diacetic acid (SEDA), isoserine-N,N-diacetic acid (ISDA), phenylalanine-N,N-diacetic acid (PHDA), anthranilic acid-N,N-diacetic acid (ANDA), sulfanilic acid-N,N-diacetic acid (SLDA), taurine-N,N-diacetic acid (TUDA) and sulfomethyl-N,N-diacetic acid (SMDA) and alkali metal salts or ammonium salts thereof.

Further preferred succinate compounds are described in U.S. Pat. No. 5,977,053 and have the formula;

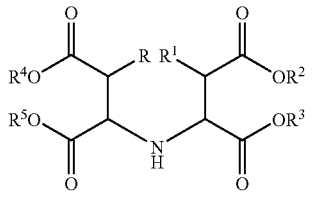

in which R, $R^1$, independently of one another, denote H or OH, $R^2$, $R^3$, $R^4$, $R^5$, independently of one another, denote a cation, hydrogen, alkali metal ions and ammonium ions, ammonium ions having the general formula $R^6R^7R^8R^9N+$ and $R^6$, $R^7$, $R^8$, $R^9$, independently of one another, denoting hydrogen, alkyl radicals having 1 to 12 C atoms or hydroxyl-substituted alkyl radicals having 2 to 3 C atoms. A preferred example is tetrasodium imminosuccinate.

Preferably the total amount of builder present in the compositions is an amount of at least 5 wt %, preferably at least 10 wt %, more preferably at least 20 wt %, and most preferably at least 25 wt %, preferably in an amount of up to 70 wt %, preferably up to 65 wt %, more preferably up to 60 wt %, and most preferably up to 35 wt %. The actual amount used in the compositions will depend upon the nature of the builder used. The distinct regions may contain any proportion of the total amount of builder as desired.

The detergent compositions of the invention may further comprise a secondary builder (or cobuilder). Preferred secondary builders include homopolymers and copolymers of polycarboxylic acids and their partially or completely neutralized salts, monomeric polycarboxylic acids and hydroxycarboxylic acids and their salts, phosphates and phosphonates, and mixtures of such substances. Preferred salts of the abovementioned compounds are the ammonium and/or alkali metal salts, i.e. the lithium, sodium, and potassium salts, and particularly preferred salts is the sodium salts. Secondary builders which are organic are preferred.

Suitable polycarboxylic acids are acyclic, alicyclic, heterocyclic and aromatic carboxylic acids, in which case they contain at least two carboxyl groups which are in each case separated from one another by, preferably, no more than two carbon atoms.

Polycarboxylates which comprise two carboxyl groups include, for example, water-soluble salts of, malonic acid, (ethylenedioxy)diacetic acid, maleic acid, diglycolic acid, tartaric acid, tartronic acid and fumaric acid. Polycarboxylates which contain three carboxyl groups include, for example, water-soluble citrate. Correspondingly, a suitable hydroxycarboxylic acid is, for example, citric acid.

Another suitable polycarboxylic acid is the homopolymer of acrylic acid. Other suitable builders are disclosed in WO 95/01416, to the contents of which express reference is hereby made.

Preferably the total amount of co-builder present in the compositions is an amount of up to 10 wt %, preferably at least 5 wt %. The actual amount used in the compositions will depend upon the nature of the builder used. The distinct regions may contain any proportion of the total amount of co-builder as desired.

Polymers intended to improve the cleaning performance of the detergent compositions may also be included therein. For example sulphonated polymers may be used. Preferred examples include copolymers of $CH_2{=}CR^1{-}CR^2R^3{-}O{-}C_4H_3R^4{-}SO_3X$ wherein $R^1$, $R^2$, $R^3$, $R^4$ are independently 1 to 6 carbon alkyl or hydrogen, and X is hydrogen or alkali with any suitable other monomer units including modified acrylic, fumaric, maleic, itaconic, aconitic, mesaconic, citraconic and methylenemalonic acid or their salts, maleic anhydride, acrylamide, alkylene, vinylmethyl ether, styrene and any mixtures thereof. Other suitable sulfonated monomers for incorporation in sulfonated (co)polymers are 2-acrylamido-2-methyl-1-propanesulphonic acid, 2-methacrylamido-2-methyl-1-propanesulphonic acid, 3-methacrylamido-2-hydroxy-propanesulphonic acid, allysulphonic acid, methallysulphonic acid, 2-hydroxy-3-(2-propenyloxy)propanesulphonic acid, 2-methyl-2-propenen-1-sulphonic acid, styrenesulphonic acid, vinylsulphonic acid, 3-sulphopropyl acrylate, 3-sulphopropylmethacrylate, sulphomethylacrylamide, sulphomethylmethacrylamide and water soluble salts thereof. Suitable sulphonated polymers are also described in U.S. Pat. No. 5,308,532 and in WO 2005/090541.

When a sulfonated polymer is present, it is preferably present in the composition in an amount of at least 0.1 wt %, preferably at least 0.5 wt %, more preferably at least 1 wt %, and most preferably at least 3 wt %, up to 40 wt %, preferably up to 25 wt %, more preferably up to 15 wt %, and most preferably up to 10 wt %. The distinct regions may contain any proportion of the total amount of sulphonated polymer as desired.

The detergent composition according to the invention may also comprise one or more foam control agents. Suitable foam control agents for this purpose are all those conventionally used in this field, such as, for example, silicones and their derivatives and paraffin oil. The foam control agents are preferably present in the composition in amounts of 5% by weight or less of the total weight of the composition. The amount in each distinct region may be chosen as desired.

If any distinct region of the detergent composition is in the form of a shaped body or a tablet then a conventional amount of a binder material may be included in that region. Any conventional binders may be used, typically in an amount of up to 10% wt, more preferably in an amount of up to 5% wt in that distinct region. Suitable binders include polyethylene glycols.

The detergent compositions of the invention may also comprise minor, conventional amounts of perfumes and/or colourants in any one or more of the distinct regions. Thickeners may also be used in paste and gel distinct regions. Any suitable thickeners may be used with gums, polymers and gels being preferred. Such ingredients are typically present in amounts of up to 2% wt in the region in which they are used.

g) Preparation of the Detergent Compositions

The compositions of the invention may be made by any suitable method depending upon their format. For example wherein the composition comprises solid or semi-solid distinct regions these may be made by conventional techniques such as by compression of material, e.g. granular/particulate material, in a mould or by casting or extrusion methods including injection moulding. The regions may be made separately and the final compositions produced by contacting those regions or by producing the regions sequentially upon each other, or by producing each region concurrently. Manufacturing methods for detergent compositions are well known in the art and do not require further explanation here.

It is especially preferred that the second distinct region (predominantly comprising the anti-corrosion agent) is a solid and is produced by pressing a (particulate) material to produce a solid distinct region.

The invention is further described with reference to the following non-limiting Examples. Further examples within the scope of the invention will be apparent to the person skilled in the art.

EXAMPLES

A detergent composition according to the present invention was produced according to the following formulation given in Table 1. The detergent composition comprised three distinct solid regions and was of rectangular appearance with a weight of about 20 g. All regions were produced by the compaction of the particulate formulations given in Table 1 to produce a solid material. The particulate material to produce region A was introduced into a mould and compacted by a die to produce a first distinct region. The particulate material to produce distinct region B was introduced into the mould on top of region A and compacted in the same way to produce a two layer detergent tablet. A cavity lying approximately centrally on the upper face of the compacted region B was produced by further compaction by a die. Separately, a disk shaped solid portion was produced by compaction of the formulation of region C given in the table. The disk was adhered to the two layer tablet in the pre-formed cavity using adhesive.

Region A is the region predominantly comprising the bleaching compound and comprises 64.5% wt of the composition and has a pH in the range 10-11.

Region B is the region separating regions A and C and comprises 27.79% wt of the composition and has a pH in the range 10-11.

Region C is the region predominantly comprising the enzyme and comprises 7.13% wt of the composition and has a pH in the range 6-8.

All percentages in Table A are given as % wt of the distinct region and also as the % wt of the detergent composition.

TABLE 1

| Component | Region A | Region B | Region C | Total composition |
|---|---|---|---|---|
| Sodium percarbonate | 15.38 | — | — | 9.92 |
| Sodium tripolyphosphate | 46.87 | 43.71 | — | 42.87 |
| Sodium silicate | 3.95 | — | — | 2.54 |
| Sodium bicarbonate | — | — | 31.77 | 2.26 |
| Citric acid anhydrous | — | — | 13.33 | 0.95 |
| Sodium carbonate | 20.59 | 35.15 | — | 23.05 |
| PEG 1500/6000 (1:2 wt ratio) | 8.0 | 6.0 | 8.0 | 7.83 |
| Sodium HEDP | 0.20 | — | — | 0.13 |
| TAED | — | 6.74 | — | 1.87 |
| Amylase/protease mix | — | — | 12.54 | 0.88 |
| Lactose | — | — | 18.0 | 1.28 |
| Cellulose | — | — | 13.77 | 0.98 |
| Magnesium stearate | — | — | 0.3 | 0.02 |
| Dye and perfume | — | 0.37 | 0.3 | 0.12 |
| Ethoxyated/propoxylated non-ionic surfactant[1] | — | 1.95 | — | 0.54 |
| Benzotriazole | — | — | 3.26 | 0.32 |
| Glycerol | 0.4 | 0.4 | — | 0.37 |
| Water | To 100% | To 100% | To 100% | To 100% |

[1]= commercially available as Plurafac LF 500

The detergent compositions showed good stability of the anti-corrosion agent and good anti-corrosion performance in automatic dishwashing applications.

The invention claimed is:

1. A detergent composition comprising three or more distinct regions, the composition comprising one or more anti-corrosion agents selected from benzotriazole or bis-benzotriazole and substituted derivatives thereof and/or metal salts or complexes chosen from the group consisting of zinc, cobalt and bismuth salts and/or complexes and a bleaching compound, wherein, a) at least 60% wt of the total amount of the bleaching compound in the detergent composition is located in a first distinct region, which region is substantially free of anti-corrosion agents;

b) at least 95% wt of the total amount of one or more anti-corrosion agents in the detergent composition are located in a second distinct region having a pH, measured as a 1% wt solution, in the range of from 5 to 8.9 which second distinct region is not in direct contact with the first distinct region, wherein the second distinct region further comprises from 1% wt to 10% wt of the total amount of the bleaching compound in the detergent composition, and further wherein the second distinct region has a lower pH than the first distinct region; and c) at least one further distinct region located between the first and second distinct regions comprises less than 5% wt of the total amount of anti-corrosion agents in the composition.

2. A detergent composition according to claim 1, wherein the detergent composition is an automatic dishwashing detergent composition.

3. A detergent composition according to claim 1, wherein the first distinct region comprises less than 5% wt of the total amount of anti-corrosion agents present in the detergent composition.

4. A detergent composition according to claim 1, wherein the second distinct region comprises 99% wt of the total amount of anti-corrosion agents present in the detergent composition.

5. A detergent composition according to claim 1, wherein the first distinct region comprises at least 70% wt of the total amount of bleaching compound present in the detergent composition.

6. A detergent composition according to claim 1, wherein the second distinct region comprises 5% wt of the total amount of bleaching compound present in the detergent composition.

7. A detergent composition according to claim 1, wherein the second distinct region comprises 100% wt of the total amount of anti-corrosion agents in the detergent composition.

8. A detergent composition according to claim 1, wherein the first distinct region comprises at least 90% wt of the total amount of bleaching compound in the detergent composition.

9. A detergent composition according to claim 1, wherein the pH of the first distinct region, measured as a 1% wt solution, is in the range of from pH 9 to 13.

10. A detergent composition according to claim 1, wherein the pH of the second distinct region, measured as a 1% wt solution, is in the range of from pH 5.2 to 8.5.

11. A detergent composition according to claim 1, wherein the at least one anti-corrosion agent comprises a substituted benzotriazole.

12. A detergent composition according to claim 1, wherein the bleaching compound is selected from the sodium and potassium salts of percarbonate, perborate and persulphate.

13. A detergent composition according to claim 1, wherein the bleaching compound is present in an amount of from 5 to 25 wt %.

14. A detergent composition according to claim 1, wherein the detergent composition comprises at least two distinct regions which are solid.

15. A detergent composition according to claim 1, wherein the composition further comprises at least one enzyme.

16. A detergent composition according to claim 1, wherein the composition comprises three distinct regions;

1) the first distinct region having a pH in the range 10 to 12 and comprising 40 to 80% wt of the total weight of the composition
2) the second distinct region having a pH in the range of from 5.5 to 8 and comprising 2 to 15% wt of the total weight of the composition, and
3) the at least one further distinct region having a pH in the range of from pH 10 to 12 and comprising from 15 to 35% wt of the total weight of the composition, and wherein the pH in each region is measured as a 1% wt solution.

17. A detergent composition according to claim 1, wherein the second distinct region is a solid.

18. A process of cleaning soiled items comprising the step of:

contacting the soiled items with a detergent composition according to claim 1.

* * * * *